United States Patent [19]

Nilsson, deceased

[11] Patent Number: 4,622,029

[45] Date of Patent: Nov. 11, 1986

[54] ARRANGEMENT IN CONNECTION WITH A CENTRIFUGAL SEPARATOR

[75] Inventor: Vilgot Nilsson, deceased, late of Hagersten, Sweden, by Mary Nilsson, Goran Nilsson, heirs

[73] Assignee: Alfa-Laval Marine and Power Engineering AB, Tumba, Sweden

[21] Appl. No.: 683,622

[22] Filed: Dec. 19, 1984

[30] Foreign Application Priority Data

Dec. 21, 1983 [SE] Sweden ..... 8307075

[51] Int. Cl.[4] ..... B04B 11/00

[52] U.S. Cl. ..... 494/2; 494/10

[58] Field of Search ..... 494/2, 4, 3, 10, 56; 210/360.1, 781, 782

[56] References Cited

U.S. PATENT DOCUMENTS

| | | | |
|---|---|---|---|
| 3,642,196 | 2/1972 | Nilsson | 494/2 |
| 4,149,668 | 4/1979 | Zurbruggen | 494/2 |
| 4,151,950 | 5/1979 | Gunnewig | 494/2 |

*Primary Examiner*—Robert W. Jenkins

*Attorney, Agent, or Firm*—Cyrus S. Hapgood

[57] ABSTRACT

In a centrifugal separator for the separation of two liquids the radially outermost part of the separating chamber (7) of the rotor communicates with a central outlet chamber (26) for the separated heavier liquid via a calibrated opening (27). From the outlet chamber (26) a channel (32–34) in a stationary outlet member (31) extends out of the rotor to a reception place for separated heavy liquid. Said channel (32–34) comprises a shut-off valve (35) and has between this and the outlet chamber (26) a calibrated outlet (36) intended to enable a certain liquid flow through at least part of the channel (32–34), while the valve (35) is closed. The throughflow areas of the calibrated opening (27) and the calibrated outlet (36), respectively, are chosen such that, when the valve (35) is closed, the liquid surface in the outlet chamber (26) will be adjusted to a relatively low level, so that unneccessary heat generation is avoided.

6 Claims, 2 Drawing Figures

ARRANGEMENT IN CONNECTION WITH A CENTRIFUGAL SEPARATOR

Figure 2:
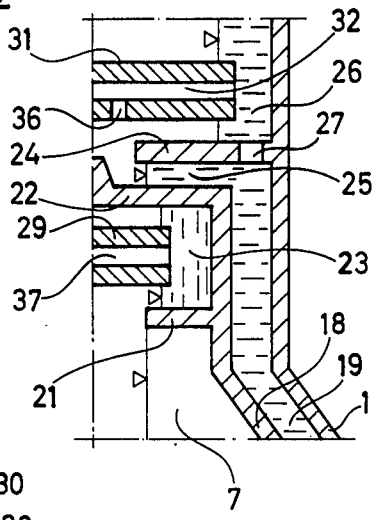

The present invention concerns an arrangement in connection with a centrifugal separator, the rotor of which has an inlet for a mixture of two liquid components to be separated and two outlets for the respective separated components, the separating chamber of the rotor communicating with an outlet chamber, defined centrally within the rotor, for the heavier one of the components, in which chamber there is arranged a stationary outlet member comprising at least one channel starting from the outlet chamber and leading to a reception place outside the rotor for the separated heavier component, valve means actuatable during the operation of the rotor being arranged to admit, alternatively to prevent, liquid flow through said channel from the outlet chamber to said reception place.

A centrifugal separator of this kind is described in the British patent specification No. 1 359 157 and is intended to be used in connection with freeing of oil from water and solid particles.

A problem in connectionn with centrifugal separators of this kind has proved to be that a relatively high temperature arises in the central outlet chamber during the time when liquid is prevented from flowing between this and the reception place for separated heavy liquid component. The reason therefore is that the central outlet chamber during this period of time is filled by separated light liquid component which adopts such a high level in the outlet chamber that the stationary outlet member therein be immerged relatively deeply within the liquid. Hereby heavy friction arises between the rotating liquid and the stationary outlet member, the heat thus formed being accumulated in the liquid present in the outlet chamber.

Especially when the separated light component is constituted by oil it is a disadvantage that a high temperature arises in the outlet chamber.

The object of the present invention is to resolve the above presented problem, so that a temperature may be maintained within the outlet chamber, which does not substantially exceed the temperature of the liquid being under treatment within the separating chamber of the rotor.

This object may be obtained according to the invention in a centrifugal separator of the initially described kind by an arrangement comprising a calibrated opening in the connection between the separating chamber and the outlet chamber for limiting of the liquid flow into the outlet chamber, stationary outlet means extending into the outlet chamber and comprising a calibrated outlet for liquid leaving the outlet chamber while said valve means prevents liquid from flowing through said channel to said reception place, said calibrated opening and said calibrated outlet having throughflow areas such that they let through the same amount of liquid per unit of time at a predetermined liquid level in the outlet chamber, as long as said means prevent liquid from flowing through the channel to said reception place. The initially mentioned stationary outlet member and the above mentioned stationary outlet means could be separate devices. However, preferable said calibrated outlet is constituted by an outlet from said channel, situated between the outlet chamber and said valve means.

In this way it is possible to maintain such a low liquid level within the outlet chamber—even when liquid is prevented from flowing therefrom to the reception place for separated heavy liquid component—that a minimum of frictional heat will be generated in the outlet chamber. The throughflow area of the calibrated opening and the calibrated outlet, respectively, is chosen with respect to such a liquid level within the outlet chamber that, when separated heavy liquid component is to be removed from the centrifuge rotor and be conducted to said reception place, the required pumping pressure is achieved therefor at the outlet member arranged in the outlet chamber.

Within the scope of the invention it is possible to connect said calibrated outlet to the inlet of the centrifuge rotor or to some separate vessel outside the rotor. However, according to a preferred embodiment of the invention the calibrated outlet is arranged to discharge liquid flowing therethrough to the separating chamber of the rotor. This is preferably arranged such that the radially outermost part of the separating chamber communicates with a space defined centrally within the rotor, to which space said liquid is conducted through the calibrated outlet.

In the following the invention will be described with reference to the accompanying drawing. In the drawing FIG. 1 shows a cross section of a centrifugal separator, and FIG. 2 shows an enlarged portion thereof.

Figure 1:
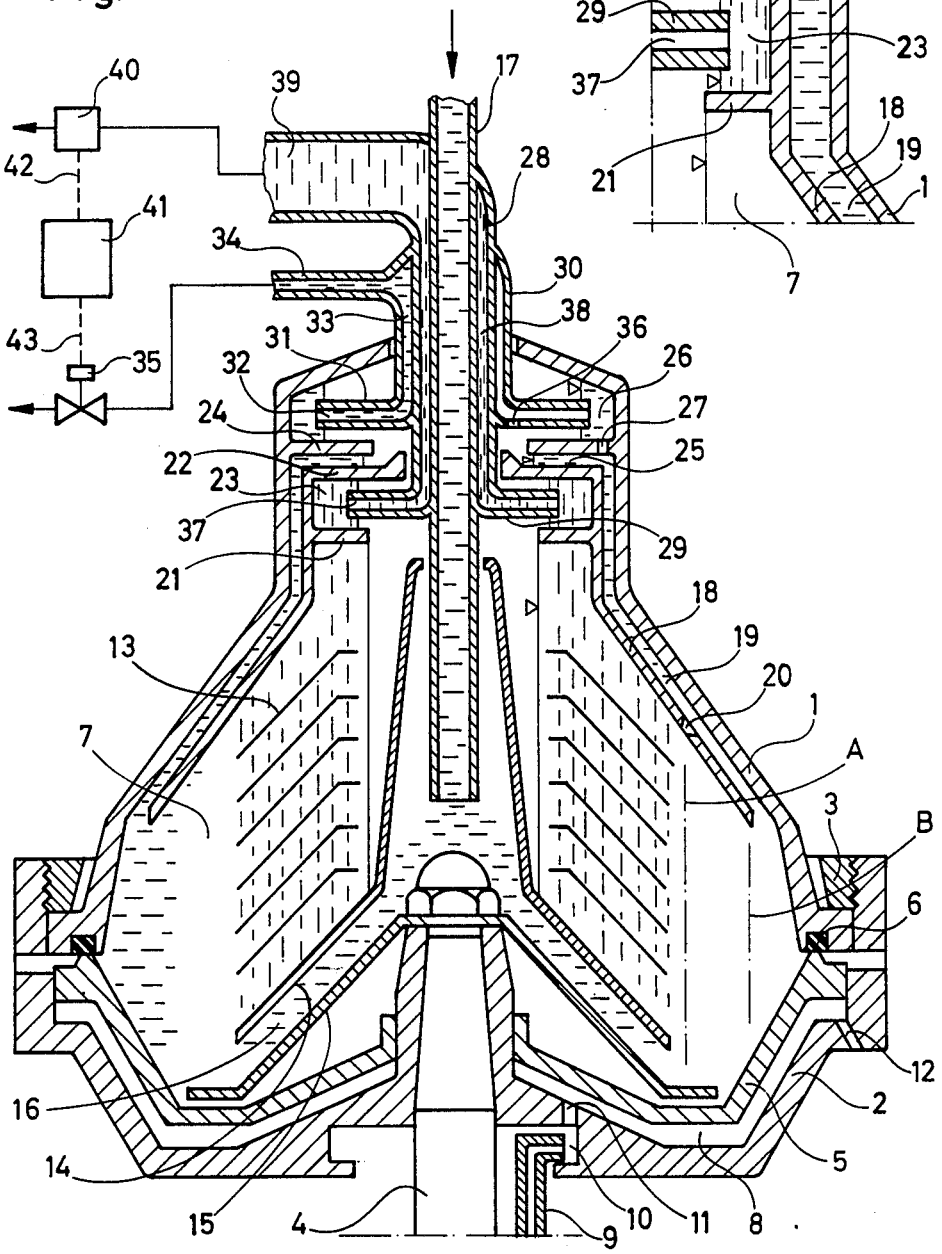

The centrifugal separator in FIG. 1 comprises a rotor consisting of two parts 1 and 2, which are kept together by means of a lock ring 3. The rotor is supported by a driving shaft 4.

Within the rotor there is a slide member 5 axially movable to and from sealing against an annular gasket 6. Between the slide member 5 and the upper rotor part 1 there is formed a separating chamber 7, and between the slide member 5 and the lower rotor part 2 there is formed a chamber 8 intended to contain a so called operating liquid.

Means 9 is arranged for the supply of operating liquid to a space 10 defined by the rotor part 2, from where a channel 11 leads to said chamber 8. A throttled channel 12 is leading from the radially outermost part of the chamber 8 through the rotor part 2 to the outside of the rotor.

Within the separating chamber 7 there is arranged a set of conical separating discs 13. These are resting on a so called distributor 14 which in the lower part of the rotor forms together with a conical plate 15 an inlet 16 to the separating chamber 7.

The upper part of the distributor 14 surrounds a space centrally within the rotor, into which there extends a stationary pipe 17 for the supply of a liquid mixture of components to be separated within the rotor.

On the upper side of the disc set within the separating chamber (only a few discs 13 are shown in the drawing) there is resting an upper conical plate 18 which is thicker than the discs 13 and which extends somewhat longer radially outwards in the separating chamber than these. The plate 18 forms together with the upper rotor part 1 a channel 19 and has at substantially the level of the outer edges of the separatign discs a through hole 20.

In the upper part of the rotor the upper plate 18 has two radially inwards directed annular flanges 21 and 22, which between themselves form a chamber 23. The upper flange 22 extends longer radially inwards than the flange 21. Above the uppermost flange 22 the upper rotor part 1 supports an annular inwardly directed flange 24, which extends somewhat longer radially inwards than the lowermost flange 21. Between the flanges 24 and 22 there is left a space 25 which through the channel 19 communicates with the separating chamber 7.

Between the uppermost portion of the rotor part 1 and the flange 24 supported thereby there is formed a chamber 26 which communicates with said space 25 through a calibrated opening means 27 in the flange 24.

The preveiously described inlet pipe 17 carries a coaxially surrounding pipe 28 which at its lower end carries a so called paring disc 29. The paring disc 29 is arranged within the previously mentioned chamber 23.

The pipe 28 in turn carries a coaxially surrounding pipe 30 which at its lower end carries a paring disc 31. The paring disc 31 is arranged within the previously mentioned chamber 26 and has several channels 32—distributed around the paring disc—which through an annular channel 33 communicate with an oulet conduit 34. In the outlet conduit 34 there is arranged a shut off valve 35.

In one or some of its channels 32 the paring disc 31 has a calibrated opening 36, which is thus constituting a calibrated outlet means from the connection extending between the chamber 26 and the valve 35.

The previously mentioned paring disc 29 has paring channels 37 which through an annular channel 38 communicates with a conduit 39. In the conduit 39 there is arranged sensing means 40 of any conventional kind, arranged for sensing whether a certain liquid flowing within the conduit 39 contains fractions of another liquid.

Control equipment 41 is connected through lines 42 and 43 to the sensing means 40 and the valve 35, respectively.

The above described centrifugal separator may be used for purifying oil, for instance heavy fuel oil, from water and solid particles. A mixture of these components, heated to about 100° C., is supplied into the centrifuge rotor though the conduit 17, from where it flows through the channel 16 into the separting chamber 7.

At this stage the chamber 8 between the slide member 5 and the rotor part 2 is filled with operating water, so that the slide member 5 is kept pressed against the gasket 6. A small amount of operating water constantly leaves the chamber 8 through the hole 12, but the corresponding amount of new operating water is continuously supplied through the means 9.

In the separating chamber 7 separated oil moves towards the centre of the rotor and flows into the chamber 23, from where it is pumped by the paring disc 29 through the channels 37 and 38 to the outlet conduit 39. The radially inwards directed annular flange 21 forms an overflow outlet from the separating chamber for the separated oil, why the liquid level in the separating chamber is determined by the position of the inner edge of the flange 21.

Separated oil will flow towards the rotor centre even within the channel 19 between the upper plate 18 and the rotor part 1. From the channel 19 the oil enters the central space 25, where a surface is formed at the same level as in the separating chamber 7.

A certain amount of oil flows through the calibrated opening 27 in the flange 24 into the chamber 26. From there oil is pumped by the paring disc 31 through the channels 32 and 33 into the conduit 34 to the valve 35.

In a starting position the valve 35 is closed and, therefore, there is no further flow of oil through the conduit 34, after the channels 32 and 33 and the conduit 34 have been filled. However, the paring disc 31 continues to pump oil out of the chamber 26, which oil is discharged through the calibrated outlet 36 (FIG. 2) some distance within one of the channels 32 of the paring disc. The oil flowing out through the outlet 36 is collected in the space 25, where it can not influence the liquid level and from where it can again flow into the chamber 26 through the opening 27.

The openings 27 and 36 are dimensioned such that the same amount of oil per unit of time will flow therethrough, whereby the liquid level in the chamber 26 can be maintained as far radially outwards as can be accepted for the achievement of a satisfactory outflow of separated water, as will be described later.

If the oulet 36 and/or the perforated flange 24 had not existed, the liquid level in the chamber 26—at the stage now in question—would have been the same as in the separating chamber 7. This would have meant that a relatively large part of the surface of the paring disc 31 had been in contact with oil rotating within the chamber 26, which had meant that the temperature in this chamber would have become undesirably high.

In operation of a centrifuge rotor of the above described kind having no outlet 36 and no perforated flange 24, a temperature of about 150° C. has been measured in the chamber 26. By the arrangement now described and shown in the drawing this temperature could be lowered to about 105° C.

After some time of operation, when so much separated water has been accumulated in the radially outermost part of the separating chamber that the interface layer between oil and water is situated at a level A in the separating chamber, fractions of water start to be entrained by the separated oil leaving through the conduit 39. This is sensed by the means 40 which emit a signal to the control equipment 41. The control equipment 41 in turn opens the valve 35 and keeps it open a predetermined period of time. During this period of time so much separated water is allowed to leave the separating chamber 7 through the channel 19 and pass through the flow determining opening 27 in the flange 24, that the interface layer in the separating chamber between oil and water is moved to a level B.

After the valve 35 has been closed, the water which at this stage is present in the chamber 26, the space 25 and the channel 19, will flow back to the separating chamber, oil then flowing through the hole 20 in the upper plate 18 and refilling said spaces to the levels as shown in the drawing.

In the manner described above separated water may be intermittently led away from the separating chamber 7. Solid particles separated in the separating chamber as a rule can be removed more seldom. This is accomplished by temporary interruption of the supply of operating water through the supply means 9. The control equipment 41 then may be programmed such that for instance every forth time a signal is emitted thereto, indicating that the interface layer between oil and water in the separating chamber has reached the level A, the valve 35 is kept close whereas, instead, the supply of operating liquid to the means 9 is temporarily interrupted. The slide member 5 in this way is caused to move axially downwards to leave an open slot between itself and the gasket 6. Separated solid particles and a desired amount of water then leaves the separating chamber 7 through this slot and the ports situated radially outside the slot in the rotor part 2.

On determining the mutual sizes of the calibrated openings 27 and 36 one can start from a certain desired liquid level in the chamber 26 and a certain desired size of the opening 27. (These desiderata to a certain extent depend on the conditions desired durign the periods of time when separated water shall be removed from the rotor through the chamber 26.)

By guidance of the pressure difference that will prevail in the liquid bodies on both sides of the flange 24 in the area of the opening 27 the flow through the opening 27 may be determined.

For the maintenance of the thus chosen liquid level for oil in the chamber 26 it is required that exactly the same flow that passes through the opening 27 will also pass through the outlet 36, as long as the valve 35 in the oulet conduit 34 is closed. Empirically it then has to be measured which pressure is prevailing in the channel 32 of the paring disc 31 at the place of the outlet 36, when the liquid level in the chamber 26 is situated at the desired level. After that the size of the outlet 36 may be determined, so that the two said flows will be equal. In a practical embodiment of the invention it has proved suitable to arrange an opening 27 with a diameter of 4 mm and four openings 36 each with a diameter of 3.5 mm.

After said openings 26 and 36 have been correctly dimensioned and the described arrangement has been put in operation, the liquid surface in the chamber 26 will automatically be set at the desired level. The arrangement is thus selfcontrolling.

When the valve 35 is opened intermittently, and a liquid flow will come up through the channels 32 of the paring disc 31, the static liquid pressure in the channels 32 will be lowered, which results in a reduced liquid flow through the calibrated outlet 36.

We claim:

1. In a centrifugal separator including a rotor forming a separating chamber and having an inlet for delivering to said chamber a mixture of two liquid components to be separated, the rotor also having a central outlet chamber for receiving the heavier of said components through flow connection from the separating chamber, the separator having an outlet for the lighter of said components, a stationary outlet member forming a channel leading from said outlet chamber and the rotor to an external reception place for the separated heavier component and valve means operable during rotation of the rotor to alternately allow and prevent liquid flow through said channel from the outlet chamber to said reception place, the improvement in which said flow connection to the outlet chamber includes calibrated opening means for limiting the liquid flow into the outlet chamber, said outlet chamber having stationary calibrated outlet means for discharging liquid from the outlet chamber while said valve means prevents liquid flow through said channel, said calibrated opening means and said calibrated outlet means having respective throughflow areas calibrated to allow equal rates of liquid flow therethrough at a predetermined liquid level in the outlet chamber while said valve means prevents flow through said channel.

2. The improvement of claim 1, in which said calibrated outlet means includes at least one outlet leading from said channel and located between the outlet chamber and said valve means.

3. The improvement of claim 1 or 2, in which said calibrated outlet means is arranged to discharge liquid to said separating chamber.

4. The improvement of claim 1 or 2, comprising a partition separating said outlet chamber from a central space within the rotor, said calibrated opening means extending through said partition, said flow connection including a passage extending from the outermost part of the separating chamber to said central space, said calibrated outlet means being arranged to discharge liquid to said central space.

5. The improvement of claim 4, in which said stationary outlet member includes a paring disc, said calibrated outlet means including at least one hole in the paring disc.

6. The improvement of claim 1 or 2, in which said stationary outlet member includes a paring disc, said calibrated outlet means including at least one hole in the paring disc.

* * * * *